US009156650B2

(12) United States Patent
Conway

(10) Patent No.: US 9,156,650 B2
(45) Date of Patent: Oct. 13, 2015

(54) POWER-ASSIST FIRE HOSE REEL

(71) Applicant: Anthony Scott Conway, Louisville, KY (US)

(72) Inventor: Anthony Scott Conway, Louisville, KY (US)

( * ) Notice: Subject to any disclaimer, the term of this patent is extended or adjusted under 35 U.S.C. 154(b) by 191 days.

(21) Appl. No.: 13/922,398

(22) Filed: Jun. 20, 2013

(65) Prior Publication Data

US 2014/0374528 A1 Dec. 25, 2014

(51) Int. Cl.

| | |
|---|---|
| ***B65H 75/38*** | (2006.01) |
| ***B65H 75/44*** | (2006.01) |
| ***A62C 33/02*** | (2006.01) |
| ***B65H 54/58*** | (2006.01) |
| ***B65H 75/30*** | (2006.01) |

(52) U.S. Cl.

CPC ..... *B65H 75/4457* (2013.01); *A62C 33/02* (2013.01); *B65H 54/585* (2013.01); *B65H 75/305* (2013.01); *B65H 2701/332* (2013.01)

(58) Field of Classification Search

CPC ..... B65H 2402/412; B65H 54/585; B65H 2701/332; B65H 75/4486; B65H 75/4492

USPC ..... 242/405.1–405.3, 404.2–404.3, 395, 242/390.8, 406, 588

See application file for complete search history.

(56) References Cited

U.S. PATENT DOCUMENTS

| | | | | | |
|---|---|---|---|---|---|
| 4,265,414 | A * | 5/1981 | Spradling | ..... | 242/532.6 |
| 4,280,672 | A * | 7/1981 | Santos et al. | ..... | 242/534.2 |
| 5,033,690 | A * | 7/1991 | McIver | ..... | 242/532.6 |
| 5,188,307 | A * | 2/1993 | Miller | ..... | 242/546.1 |
| 5,505,404 | A * | 4/1996 | Dubreuil | ..... | 242/532.6 |
| 5,566,901 | A * | 10/1996 | Wilder | ..... | 242/532.6 |
| 6,027,066 | A * | 2/2000 | Street | ..... | 242/532.5 |
| 6,561,450 | B1 * | 5/2003 | Walsh | ..... | 242/395 |
| 6,648,262 | B1 * | 11/2003 | Huffman | ..... | 242/390.8 |
| 6,811,110 | B2 * | 11/2004 | Tsao | ..... | 242/530.2 |
| 2002/0074443 | A1 * | 6/2002 | Murdock et al. | ..... | 242/395 |

* cited by examiner

*Primary Examiner* — Sang Kim
(74) *Attorney, Agent, or Firm* — H. Jay Spiegel

(57) ABSTRACT

A fire hose reel assembly comprising, a base, a front left angled bar, a front right angled bar, a rear left angled bar and a rear right angled bar. A top connecting bar connects the front left angled bar, the front right angled bar, the rear left angled bar and the rear right angled bar. A latch is directly attached to the top connecting bar. The fire hose reel assembly further includes a fire hose take-up rod. The fire hose reel assembly includes a fork assembly and a fork upper rod. The fork upper rod has a coupling attached to an upper end of the fork upper rod. The fork upper rod may be retained in the latch. The fork assembly is capable of retaining an end of a fire hose. A manual crank or a battery-operated or electric drill may be connected to the coupling in the upper end of the fork upper rod to provide power-assist to facilitate rolling-up the fire hose. The fire hose reel assembly in an embodiment may be mounted on wheels.

19 Claims, 8 Drawing Sheets

POWER-ASSIST FIRE HOSE REEL

RELATED APPLICATIONS

There are no related applications for this application.

FIELD

The field of the invention relates generally to devices to assist rolling fire hoses into a rolled-up shape after use.

BRIEF DESCRIPTION

A fire hose reel assembly is disclosed. The fire hose reel assembly includes a foundation. The foundation includes a horizontal base, a front left angled bar, a front right angled bar, a rear left angled bar and a rear right angled bar. The front left angled bar, the front right angled bar, the rear left angled bar and the rear right angled bar are directly attached to the horizontal base. The foundation further includes a top connecting bar attached to the front left angled bar, the front right angled bar, the rear left angled bar and the rear right angled bar and a guide mounted on the top connecting bar. In some embodiments the guide is configured as a latch. In some embodiments, the fire hose reel assembly is mounted on wheels.

The fire hose reel assembly further includes a fire hose take-up rod assembly, the fire hose reel take-up rod assembly including a fork assembly and a fork upper rod. In some embodiments, a coupling is attached to an upper end of the fork upper rod. The fork assembly is capable of being placed between a fire hose spout and a fire hose. The fork upper rod is capable of being received in the latch.

A spring-biased latch release bar is directly attached to the latch. The spring-biased latch release bar is capable of being operated between a locked position in which the fork upper bar is captivated in the latch and a release position in which the fork upper bar is capable of being removed from the latch. The spring-biased latch release bar is biased in the locked position by a spring.

The coupling is capable of receiving a power assist device including a battery-operated or electric drill, or a manual crank assembly where the fire hose is capable of being rolled-up by operation of one of the battery-operated or electric drill and the manual crank assembly, by the crank assembly or the electric drill imparting a rotational force transmitted to the fire hose and fire hose adapter.

In use, a user procures the fire hose reel assembly including the foundation and take-up rod. The user selects either the manual crank assembly or the drill for power assist. The user then connects either the manual crank assembly or the battery-operated or electric drill to connect to a coupling on the fork upper rod. The user then locates the fire hose adapter on one side of the fork assembly and the fire hose on the other side of the fork assembly. A tab on the fork assembly helps keep the fire hose and fire hose adapter secured to the fork assembly. The user then inserts the fork upper rod in the latch to secure the fork upper rod in place to facilitate easy rotation by a power-assist device. The user then utilizes the power assist device of the manual crank assembly or the drill to wind the fire hose into a rolled-up shape. In some embodiments, the wheels on the fire hose reel assembly facilitate rolling-up the fire hose.

DETAILED DESCRIPTION

Figure 1:
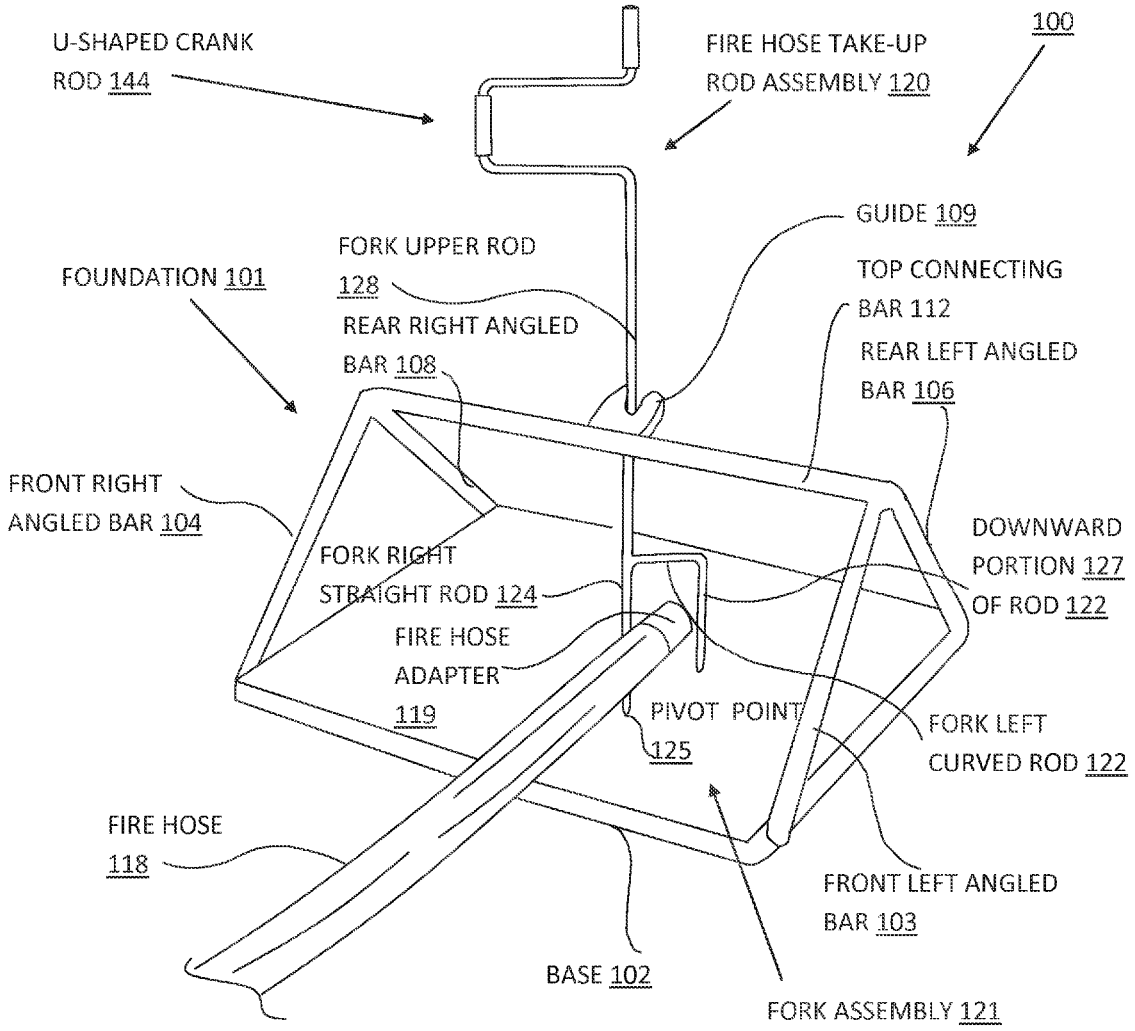
FIG. 1 is a perspective view of the fire hose reel assembly according to an implementation.
Figure 2:
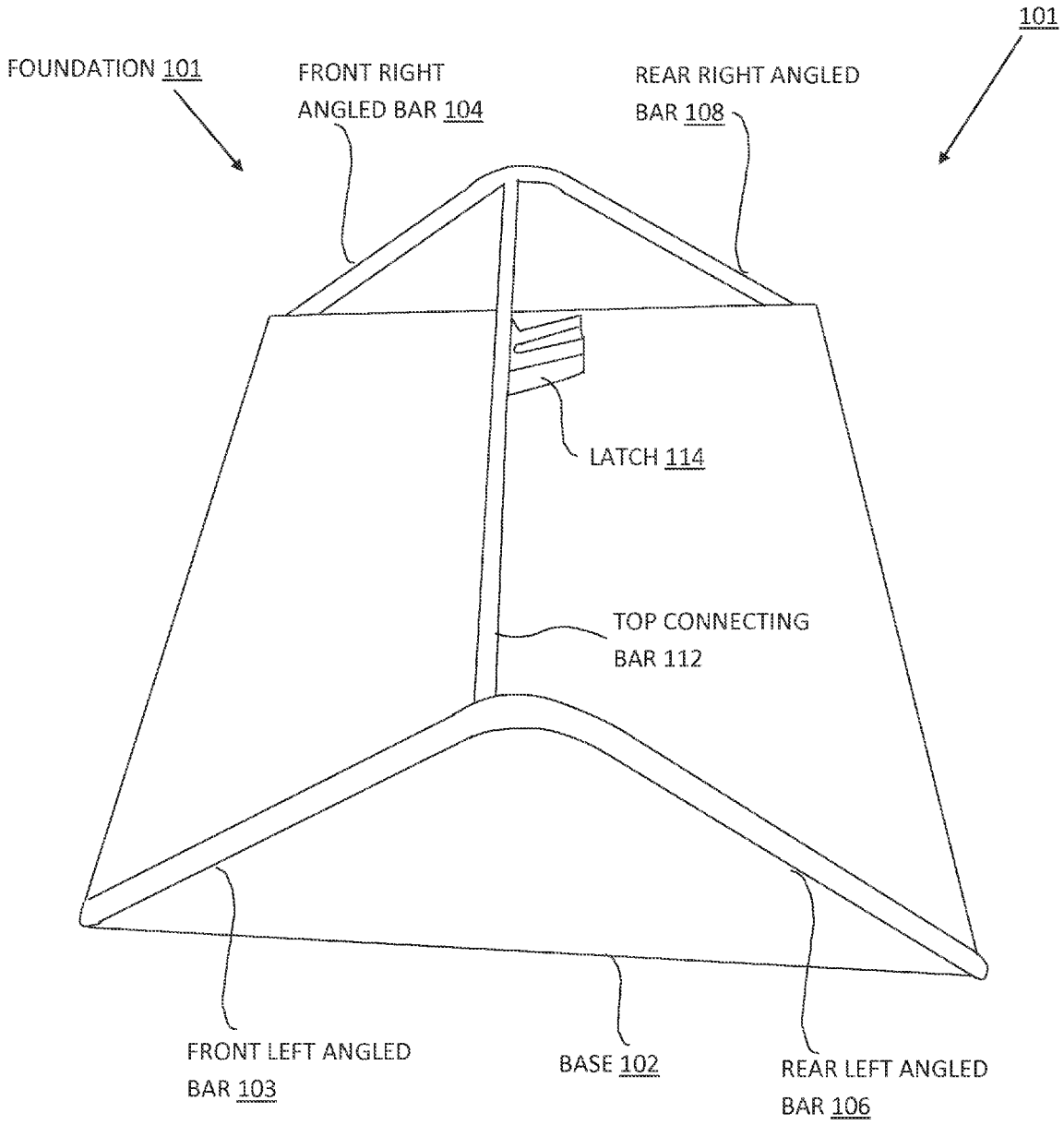
FIG. 2 is a perspective view of a foundation of the fire hose reel assembly from a side of the foundation according to an implementation.

FIG. 1 is a perspective view of the fire hose reel assembly 100. The fire hose reel assembly 100 includes a foundation 101 and a fire hose take-up rod 120. The foundation 101 includes a horizontal base 102. Mounted to the horizontal base 102 is a front left angled bar 103, a front right angled bar 104, a rear left angled bar 106, a rear right angled bar 108 and a top connecting bar 112. The front left angled bar 103, the front right angled bar 104, the rear left angled bar 106 and the rear right angled bar 108 are directly attached to the horizontal base 102. The top connecting bar 112 is directly attached to the front left angled bar 103, the front right angled bar 104, the rear left angled bar 106 and the rear right angled bar 108. Mounted on the top connecting bar 112 is a guide 109. The fire-hose take-up rod 120 includes a fork assembly 121. The fork assembly includes a fork upper rod 128. The fork upper rod 128 having a longitudinal axis along the length of the fork upper rod 128 and a length along the longitudinal axis of the fork upper rod 128. The fork assembly 121 further includes a right straight rod 124, the right straight rod 124 having a longitudinal axis along the length of the right straight rod. The fork assembly 121 additionally includes a rod 122 protruding generally perpendicular from a fork upper rod 128 and curving into a downward portion 127. The downward portion 127 of the rod 122 has a length in the downward direction. The fire-hose take-up rod 120 includes a crank rod 144. FIG. 1 also illustrates a fire hose 118 and fire hose adapter 119 captivated within the fork assembly 121 to facilitate rolling the fire hose 118 up. In an embodiment, as illustrated on FIG. 1, the longitudinal axis along the length of the right straight rod 124 of a fork assembly 121 is collinear with the longitudinal axis along the length of the fork upper rod 128. In an embodiment, as also illustrated on FIG. 1, the length of the right straight rod 124 is longer than the length of the downward portion 127 of the rod 122. In an embodiment, a lower end of the right straight rod is shaped as a cone-shaped pivot point 125. FIG. 2 is a perspective view of the foundation 101 of the fire hose reel assembly 100 from a side of the foundation 101.

Figure 3:
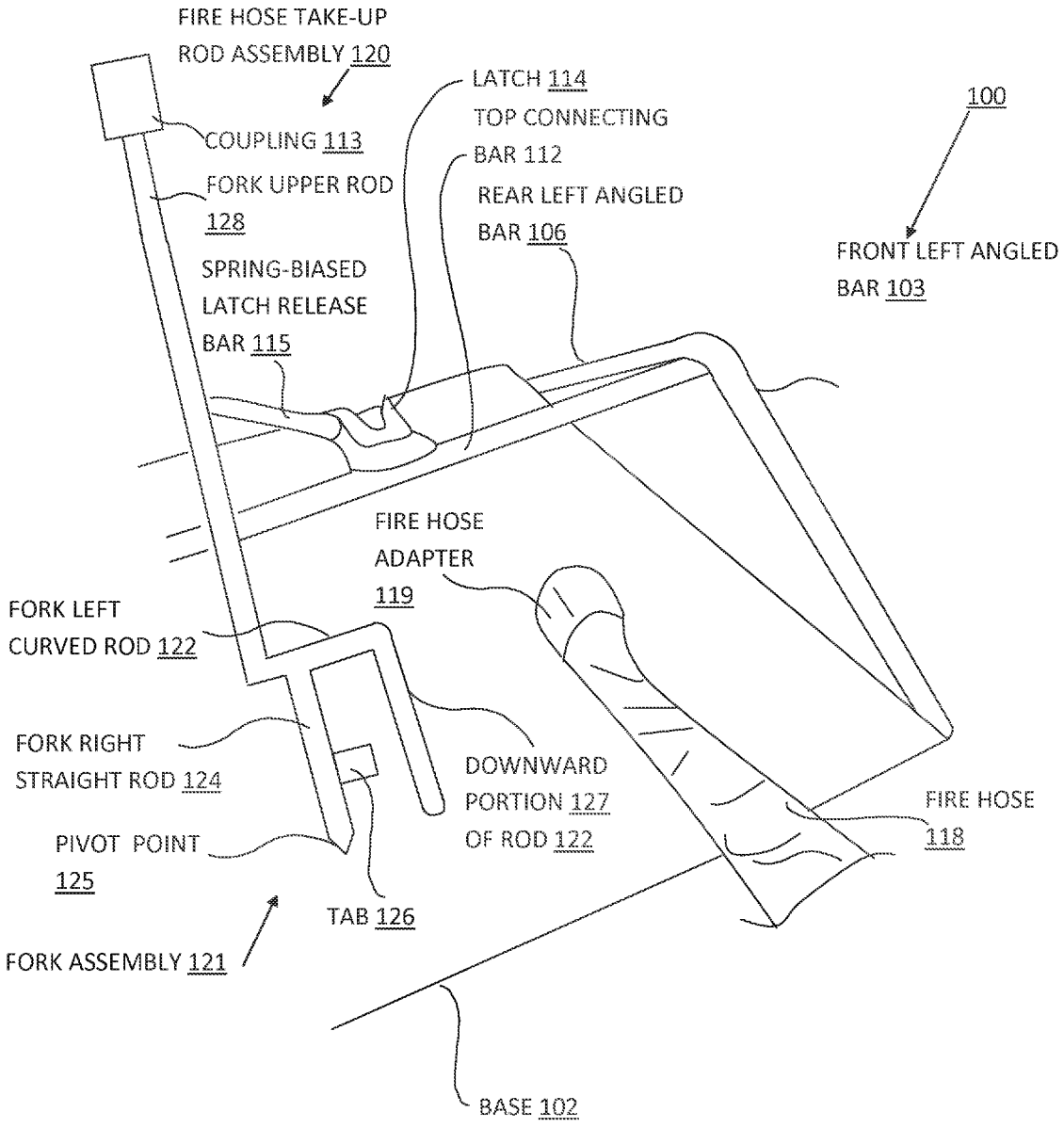
FIG. 3 is a perspective view of the foundation and the fire hose take-up rod of the fire hose reel assembly with the foundation and the fire hose take-up assembly disconnected according to an implementation.

FIG. 3 is a perspective view of the foundation 101 and the fire hose take-up rod 120 of the fire hose reel assembly 100 with the foundation 101 and the fire hose take-up assembly disconnected. In FIG. 3, the guide 109 of FIG. 1 is configured as a latch 114. As illustrated on FIG. 3, a fire hose 118 with an adapter 119 is placed on top of the base 101. As illustrated on FIG. 3, the fork assembly 121 further includes a tab 126 attached to the right straight rod 124, the tab 126 located above the cone-shaped pivot point 125. As illustrated on FIG. 3, the fork assembly includes a coupling 113 which is connected to the fork upper rod 128. In one embodiment the coupling 113 is configured as a hex-socket coupling 132. In an embodiment, as illustrated on FIG. 3, the longitudinal axis of the right straight rod 124 is parallel but offset from the longitudinal axis of the upper rod 128.

Figure 4A:
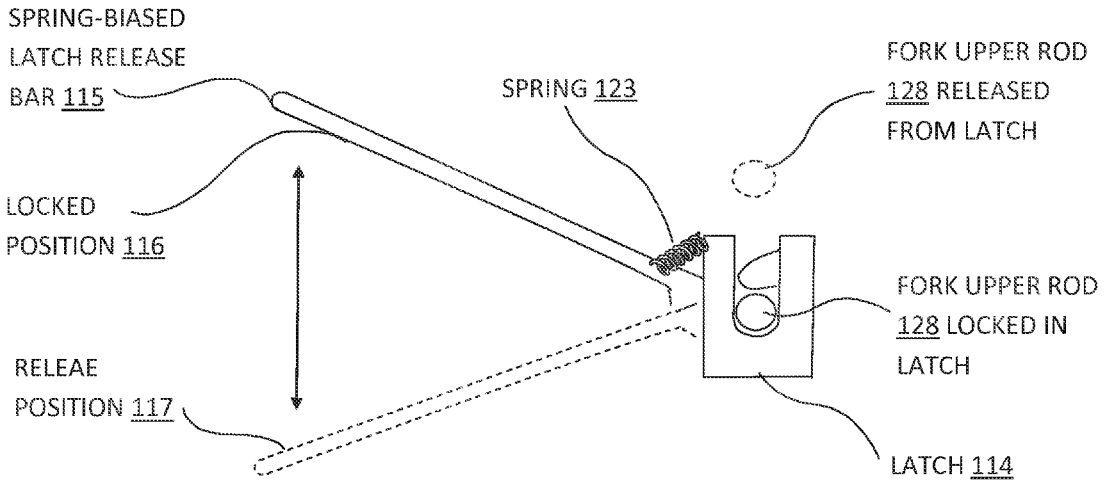
FIG. 4A is a detail view of the latch and spring-loaded latch release bar in a locked and release position according to an implementation.

FIG. 4A is a detail view of the latch 114 and spring-biased latch release bar 115 in a locked 116 and release 117 position. The spring-biased latch release bar 115 is illustrated in solid lines in FIG. 4A in the locked position 116. The spring-biased latch release bar 115 is illustrated in dashed lines in FIG. 4A in the release position 117. FIG. 4A also illustrates the spring-biased release bar 115 biased by a spring 123 in the locked position 116. FIG. 4A further illustrates the fire hose take-up upper rod 128 captivated in the latch 114 in a solid line. When the spring-biased latch release bar 115 is operated to the release position 117, the fire hose take-up upper rod 128 is able to be located outside the latch 114 as illustrated by the fire hose take-up upper rod 128 in a dashed line in FIG. 4A.

Figure 4B:
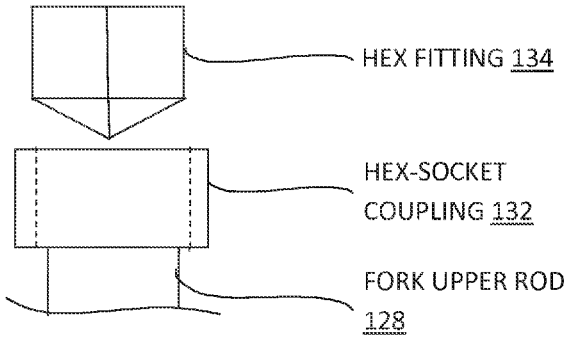
FIG. 4B is a detail view of the coupling configured as a hex-socket coupling attached to fire hose take-up fork upper rod and a hex fitting attachable to the hex-socket coupling.

FIG. 4B is a detail view of the coupling 113 configured as a hex-socket coupling 132 attached to fire hose take-up fork upper rod 112 and a hex fitting 134 attachable to the hex-socket coupling 132.

Figure 5A:
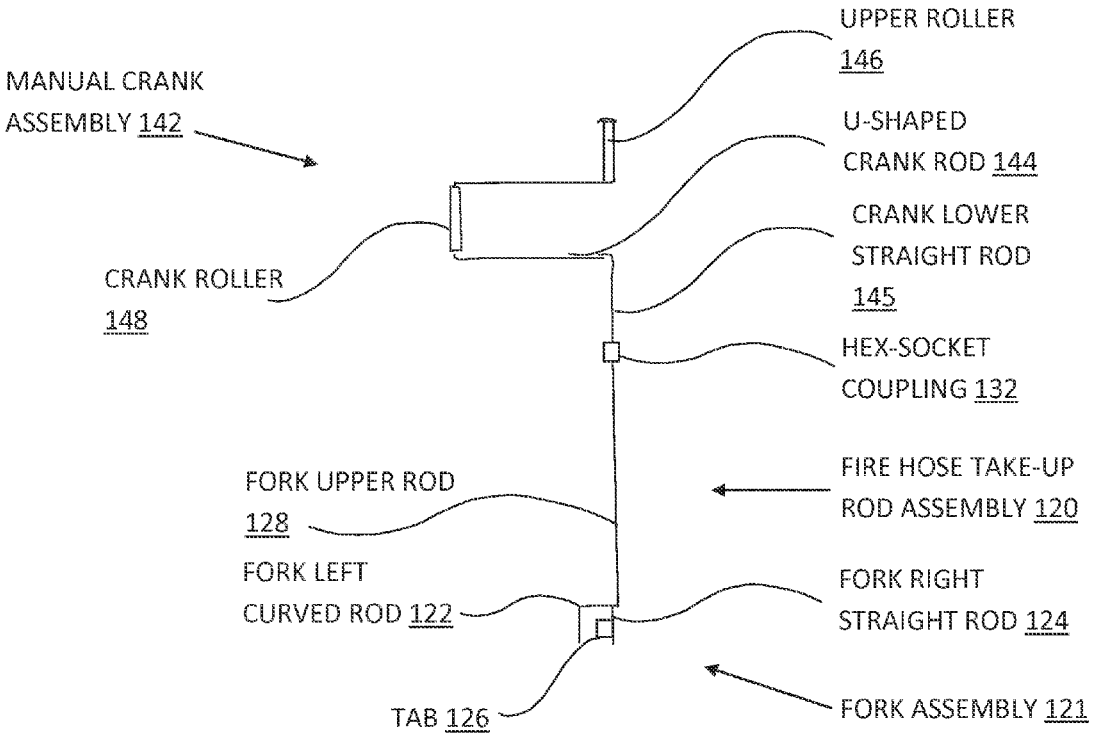
FIG. 5A is a front view of the fire hose take-up fork upper rod attached via a hex socket coupling to a manual crank according to an implementation.
Figure 5B:
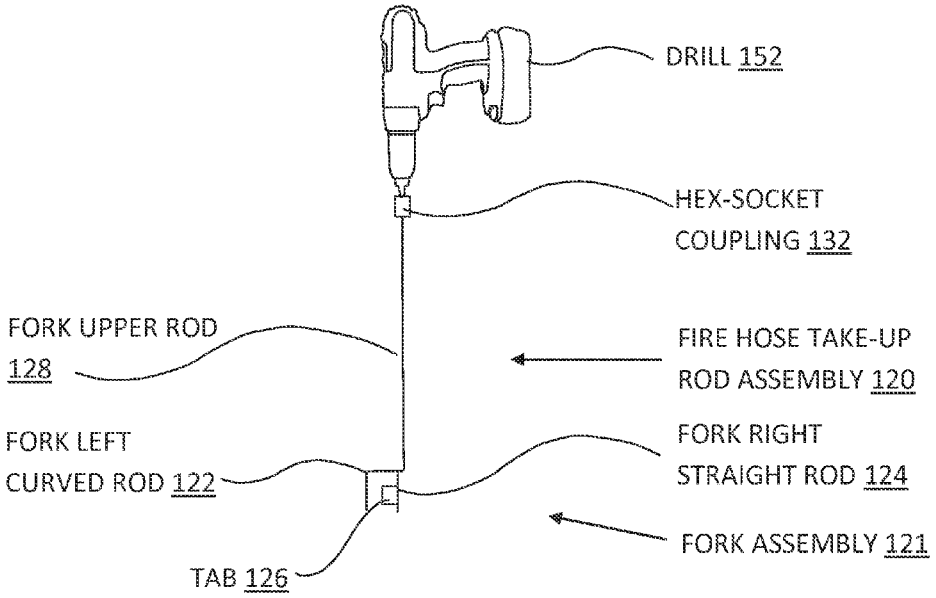
FIG. 5B is a front view of the fire hose take-up fork upper rod attached via a hex socket coupling to a drill according to another implementation.

FIG. 5A is a front view of the fire hose take-up fork upper rod 128 attached via the hex-socket coupling 132 to a manual crank assembly 142 according to an embodiment. The manual crank assembly 142 includes a generally U-shaped crank rod 144, a crank lower straight rod 145, an upper roller 146 installed on an upper portion of the crank rod 144, a crank roller 148 installed on a middle portion of the crank rod 144 and the hex fitting 134 at the bottom of the crank lower straight rod 145. FIG. 5B is a front view of the fire hose take-up fork upper rod 128 attached via a hex socket coupling 132 to a battery-operated or electric drill 152 according to another embodiment.

Figure 6:
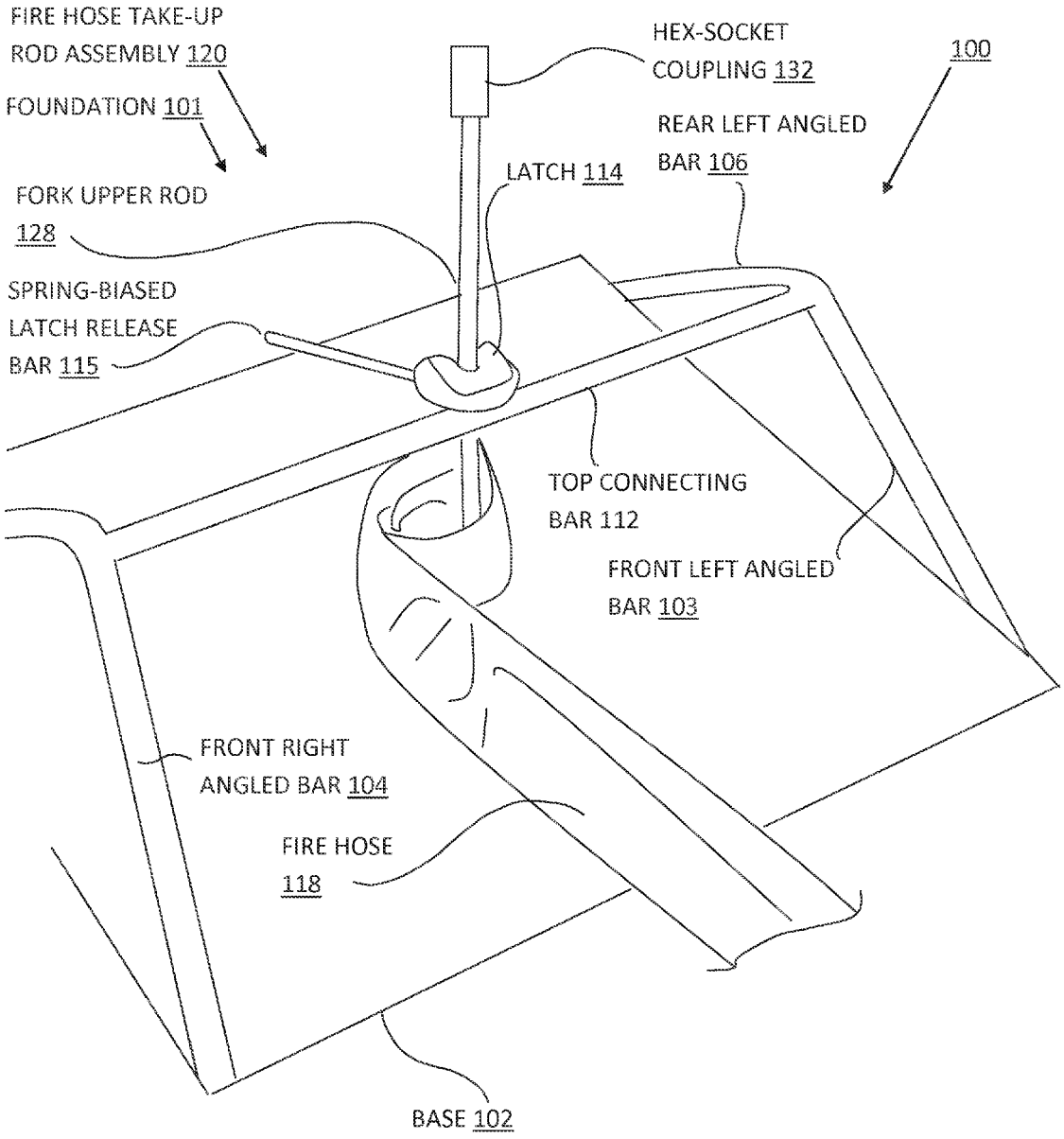
FIG. 6 is a perspective view of the fire hose reel assembly and the fire hose take-up fork upper rod illustrating the fire hose beginning to be taken-up according to an implementation.
Figure 7:
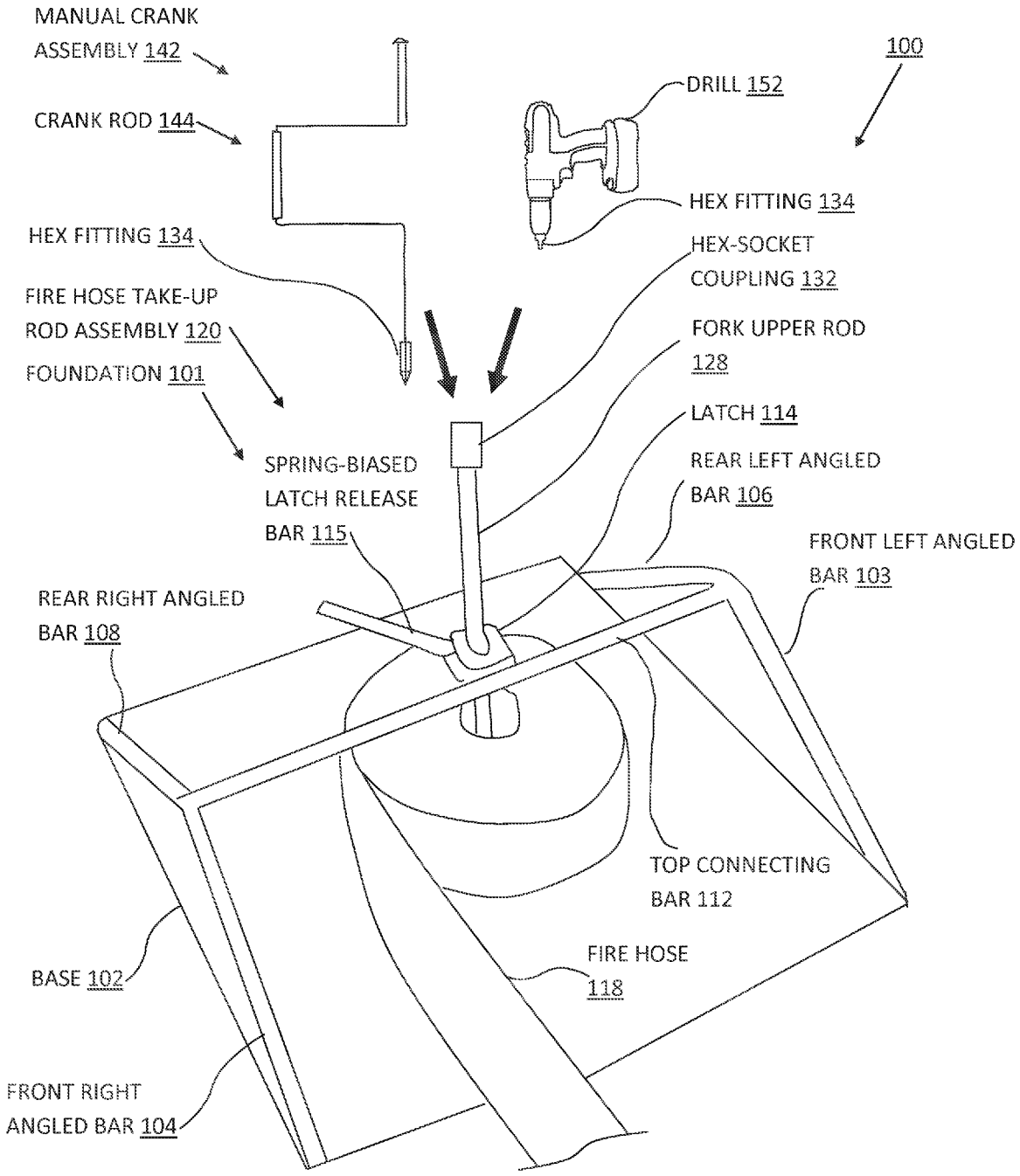
FIG. 7 is a perspective view of the fire hose reel assembly and the fire hose take-up fork upper rod illustrating the fire hose being taken-up with a power assist device either utilizing a manual crank or a drill according to an implementation.

FIG. 6 is a perspective view of the fire hose reel assembly 100 and the fire hose take-up fork upper rod 128 illustrating the fire hose 118 beginning to be taken-up by rotation of the fork assembly 121 with the hose 118 and hose adapter 119 captivated within the fork assembly 121. FIG. 7 is a perspective view of the fire hose reel assembly 100 and the fire hose take-up fork upper rod 128 illustrating the fire hose 118 being taken-up with a power assist device either utilizing the manual crank assembly 142 or the drill 152. However, the invention is not limited to power assist devices illustrated on FIG. 7.

Figure 8:
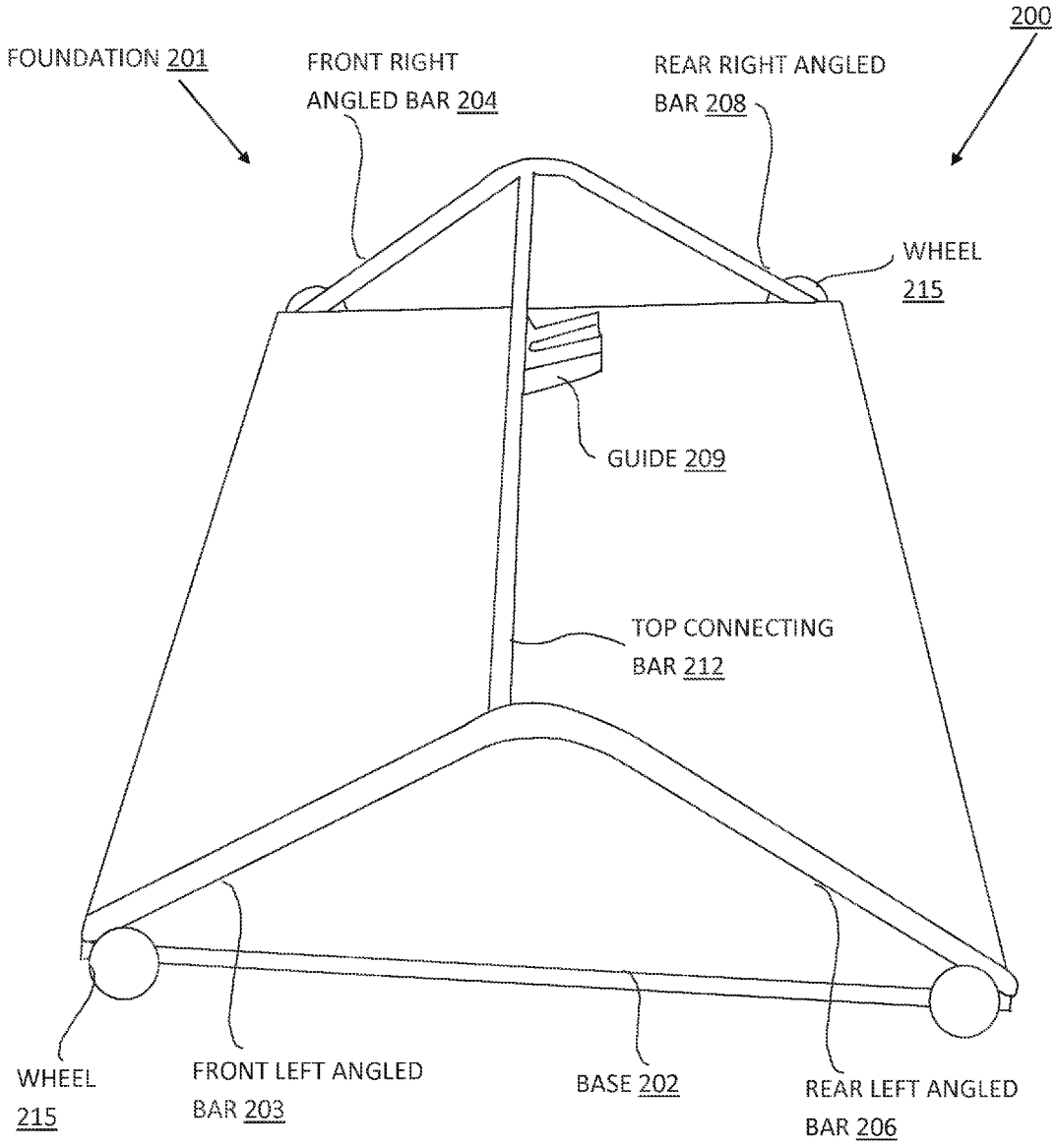
FIG. 8 is a perspective view of another embodiment of the foundation of the fire hose reel assembly including wheels as viewed from a side of the foundation according to an implementation.

FIG. 8 is a perspective view of another embodiment of the foundation of the fire hose reel assembly 200 including wheels viewed from a side of the foundation. The embodiment of FIG. 8 is generally the same in structure and function as the embodiment of FIGS. 1-7, except that the embodiment of FIG. 8 has four wheels 215 attached to the foundation. The fire hose reel assembly 200 includes a foundation 201. The foundation 201 includes a horizontal base 202. Mounted to the horizontal base 202 is a front left angled bar 203, a front right angled bar 204, a rear left angled bar 206, a rear right angled bar 208 and a top connecting bar 212. The front left angled bar 203, the front right angled bar 204, the rear left angled bar 206 and the rear right angled bar 208 are directly attached to the horizontal base 202. The top connecting bar 212 is directly attached to the front left angled bar 203, the front right angled bar 204, the rear left angled bar 206 and the rear right angled bar 208. Mounted on the top connecting bar 212 is a guide 209. In some embodiments, the guide may be configured as a latch.

In use of the embodiment of FIGS. 1-7, a user procures the fire hose reel assembly 100 including the foundation 101 and take-up rod 120 in order to roll-up a fire hose 118. The user selects either the manual crank assembly 142 or the battery-operated or electric drill 152 for power assist. The user then connects either the manual crank assembly 142 or the drill 152 with the hex fitting 134 at a lower portion of the manual crank assembly 142 or drill 152 to the hex socket coupling 132. The user then locates the fire hose adapter 119 on one side of the fork assembly 121 and the fire hose 118 on the other side of the fork assembly 121. The fork tab 126 keeps the fire hose adapter 119 on one side of the fork assembly 121 and the fire hose 118 on the other side of the fork assembly 121 to captivate the fire hose 118 and fire hose adapter 119 on the fork adapter to allow the take-up rod 120, fire hose 118 and fire hose adapter 119 to be rotated as an assembly. The user then inserts the fork upper rod 128 in the latch 114 and operates the spring-biased latch release bar 115 so that the spring-biased latch release bar 115 is in the locked position 116. The user then either attaches the manual crank assembly 142 or the battery-operated or electric drill 152 with the attached hex fitting 134 into the hex socket coupling 132. The user then utilizes the power assist of the manual crank assembly 142 or the drill 152 to wind-up the fire hose 118 into a rolled-up shape, as illustrated on FIG. 7. The use of the embodiment of FIG. 8 is the generally the same as that for FIGS. 1-7, except that the four wheels 215 attached to the horizontal base 202 facilitate rolling-up a fire hose, especially heavy, wet fire hoses, as the fire hose reel assembly 200 may be moved relative to the fire hose 118.

As a person skilled in the prior art will recognize after examination of the previous detailed description and the figures and claims, modifications and changes may be made to the preferred embodiments of the invention without departing from the scope of the invention as defined in the following claims.

The invention claimed is:

1. A fire hose reel assembly comprising:

a horizontal base, the horizontal base capable of receiving a fire hose adapter and a fire hose;

a front left angled bar, a front right angled bar, a rear left angled bar, a rear right angled bar;

the front left angled bar, the front right angled bar, the rear left angled bar and the rear right angled bar are directly attached to the horizontal base;

a top connecting bar directly attached to the front left angled bar, the front right angled bar, the rear left angled bar and the rear right angled bar;

a guide directly attached to the top connecting bar, the guide being configured as a latch and wherein a spring-biased latch release bar is attached to the latch by a spring;

a fork assembly, the fork assembly including a fork upper rod, the fork upper rod capable of being received in the guide, the fork assembly capable of being located between the fire hose and the fire hose adapter placed on the horizontal base;

a manual crank assembly, the manual crank assembly including a crank rod, the crank rod being coupled to the fork upper rod, the crank rod adapted to be manually rotated, the manual rotation of the crank rod allowing a rotational force to be imparted to the fire hose and fire hose adapter.

2. The fire hose reel assembly of claim 1 wherein the fork assembly includes a right straight rod and a rod protruding generally perpendicularly from the fork upper rod and curving downwards into a downward portion.

3. The fire hose reel assembly of claim 2 wherein a tab is directly attached to the right straight rod, wherein the tab is directly attached to the right straight rod such that a bottom edge of the tab is located above a bottom edge of the right straight rod, wherein the tab is rectangular in shape.

4. The fire hose reel assembly of claim 2 wherein a longitudinal axis along the length of the fork upper rod and a longitudinal axis along the length of the fork right straight rod are collinear.

5. The fire hose reel assembly of claim 2 wherein the right straight rod is longer in length than the downward portion of the rod protruding to the right from the fork upper rod, the right straight rod formed as a cone-shaped pivot point at a lower end of the right straight rod.

6. The fire hose reel assembly of claim 2 wherein the right straight rod has a longitudinal axis, the fork upper rod has a longitudinal axis, and the longitudinal axis of the right straight rod is offset from and substantially parallel to the longitudinal axis of the fork upper rod.

7. The fire hose reel assembly of claim 1 wherein the latch release bar is capable of being operated between a locked position and a release position.

8. The fire hose reel assembly of claim 7 wherein the latch release bar is biased in the locked position by the spring.

9. The fire hose reel assembly of claim 8 wherein the fork upper rod of the fork assembly is capable of being retained in the latch when the latch release bar is in the locked position.

10. The fire hose reel assembly of claim 1 wherein the fork upper rod is coupled to the crank rod by a coupling, the coupling having a hex socket formed in an upper portion of the coupling.

11. The fire hose reel assembly of claim 10 wherein the crank rod includes a lower straight rod, the lower straight rod has a hex fitting located on a lower end of the lower straight rod, the hex fitting capable of being received in the hex socket in the upper portion of the coupling.

12. The fire hose reel assembly of claim 1 wherein the manual crank assembly includes a crank rod and a crank lower straight rod, wherein an upper roller is mounted on an upper portion of the crank rod and a crank roller is mounted on a middle portion of the crank rod.

13. The fire hose reel assembly of claim 1 wherein four wheels are attached to the horizontal base.

14. The fire hose reel assembly of claim 1 wherein the latch release bar is able to be operated between a locked position and a release position, wherein the latch release bar is biased in the locked position by the spring, wherein the fork upper rod of the fork assembly is able to be retained in the latch when the latch release bar is in the locked position.

15. The fire hose reel assembly of claim 1 wherein the fork assembly includes a right straight rod and a rod protruding generally perpendicularly from the fork upper rod and curving downwards into a downward portion, wherein a tab is directly attached to the right straight rod, wherein the tab is directly attached to the right straight rod such that a bottom edge of the rectangular tab is located above a lower end of the right straight rod wherein the lower end of the right straight rod has a cone-shaped pivot point.

16. A fire hose reel assembly comprising:

a foundation, the foundation comprising:

a horizontal base, the horizontal base capable of receiving a fire hose adapter and a fire hose;

a front left angled bar, a front right angled bar, a rear left angled bar, a rear right angled bar;

a top connecting bar directly attached to the front left angled bar, the front right angled bar, the rear left angled bar and the rear right angled bar;

the front left angled bar, the front right angled bar, the rear left angled bar and the rear right angled bar are directly attached to the horizontal base;

a guide directly attached to the top connecting bar;

the fire hose reel assembly further comprising a fire hose take-up rod, the fire hose reel take-up rod including a fork assembly and a fork upper rod, a coupling is attached to an upper end of the fork upper rod, the fork assembly capable of being placed between a fire hose spout and a fire hose;

the fork upper rod capable of being received in the guide; and the coupling able to receive one of a battery-operated or electric drill, wherein the fire hose is capable of being rolled-up by operation of the drill.

17. The fire hose reel assembly of claim 16 wherein the guide is configured as a latch, a spring-biased latch release bar is directly attached to the latch, the spring-biased latch release bar able to be operated between a locked position in which the fork upper bar is captivated in the latch and a release position in which the fork upper bar is able to be removed from the latch, the spring-biased latch release bar being biased in the locked position by a spring.

18. A fire hose reel assembly comprising:

a foundation, the foundation comprising:

a horizontal base, the horizontal base able to receive a fire hose adapter and a fire hose;

a front left angled bar, a front right angled bar, a rear left angled bar, a rear right angled bar;

a top connecting bar directly attached to the front left angled bar, the front right angled bar, the rear left angled bar and the rear right angled bar;

the front left angled bar, the front right angled bar, the rear left angled bar and the rear right angled bar are directly attached to the horizontal base;

a guide directly attached to the top connecting bar, the guide being configured as a latch, a spring-biased latch release bar is directly attached to the latch, the spring-biased latch release bar able to be operated between a locked position in which the fork upper bar is captivated in the latch and a release position in which the fork upper bar is able to be removed from the latch, the spring-biased latch release bar being biased in the locked position by a spring, wherein the crank rod is coupled to the fork upper rod by a coupling, the coupling including a hex socket on an upper end of the coupling, wherein four wheels are attached to the horizontal base;

a fork assembly, the fork assembly including a fork upper rod, the fork upper rod able to be received in the guide, the fork assembly able to be located between the fire hose and the fire hose adapter placed on the base, the fork upper rod able to be received in the guide; and a manual crank assembly, the manual crank assembly including a crank rod, the crank rod being coupled to the fork upper rod, the crank rod able to be manually rotated, manual rotation of the crank rod imparting a rotational force to the fire hose and fire hose adapter.

19. A fire hose reel assembly comprising:

a horizontal base, the horizontal base capable of receiving a fire hose adapter and a fire hose;

a front left angled bar, a front right angled bar, a rear left angled bar, a rear right angled bar;

the front left angled bar, the front right angled bar, the rear left angled bar and the rear right angled bar are directly attached to the horizontal base;

a top connecting bar directly attached to the front left angled bar, the front right angled bar, the rear left angled bar and the rear right angled bar;

a guide directly attached to the top connecting bar;

a fork assembly, the fork assembly including a fork upper rod, the fork upper rod capable of being received in the guide, the fork assembly capable of being located between the fire hose and the fire hose adapter placed on the horizontal base, the fork assembly including a right straight rod and a rod protruding generally perpendicularly from the fork upper rod and curving downwards into a downward portion, and further including a tab directly attached to the right straight rod, wherein the tab is directly attached to the right straight rod such that a bottom edge of the tab is located above a bottom edge of the right straight rod, wherein the tab is rectangular in shape;

a manual crank assembly, the manual crank assembly including a crank rod, the crank rod being coupled to the fork upper rod, the crank rod adapted to be manually rotated, the manual rotation of the crank rod allowing a rotational force to be imparted to the fire hose and fire hose adapter.

* * * * *